United States Patent [19]

Erpenbeck

[11] 4,009,745

[45] Mar. 1, 1977

[54] WINDOW SHADE SUPPORT ROLLER AND METHOD OF ASSEMBLING

[75] Inventor: Paul J. Erpenbeck, Muskegon, Mich.

[73] Assignee: Breneman, Inc., Cincinnati, Ohio

[22] Filed: May 2, 1975

[21] Appl. No.: 573,985

[52] U.S. Cl. ..... 160/297; 160/301; 160/323 R; 160/326

[51] Int. Cl.[2] ..... E06B 9/208

[58] Field of Search ..... 160/297, 299, 301, 305, 160/304, 313, 316, 317, 318, 323, 326; 185/37, 39, 45; 188/82.8, 82.84; 192/38, 44, 45

[56] References Cited

UNITED STATES PATENTS

| | | | |
|---|---|---|---|
| 255,571 | 3/1882 | Bettencurt | 160/297 |
| 961,680 | 6/1910 | Cole | 160/297 |
| 1,093,930 | 4/1914 | Hartshorn | 160/301 |
| 2,614,629 | 10/1952 | Bleibtreu | 160/297 |
| 3,115,927 | 12/1963 | Znamirowski | 160/301 |
| 3,763,916 | 10/1973 | Gossling | 160/297 X |

*Primary Examiner*—Philip C. Kannan

*Attorney, Agent, or Firm*—Price, Heneveld, Huizenga & Cooper

[57] ABSTRACT

A window shade support roller having an improved spring motor construction and method of manufacture includes a spring retaining structure which holds a driving spring and a spear structure having an integral spear. The spear structure and the spring retaining structure cooperate together, and with a ball, to form a ball clutch mechanism. The spring retaining structure has ball-receiving recesses with canting floors which simplify assembly. Assembly steps include inserting balls into the spring retaining structure, inserting the spear structure into the spring retaining structure, inserting a dowel into the spear structure, positioning a spring around the dowel, and inserting one end of such spring between portions of the spring retaining structure, which uniquely capture and retain the end without other securement, for torsional winding of the spring.

13 Claims, 7 Drawing Figures

WINDOW SHADE SUPPORT ROLLER AND METHOD OF ASSEMBLING

BACKGROUND OF THE INVENTION

I. Field of the Invention

This invention relates to window shade support apparatus and a method for manufacturing the apparatus. More particularly, the invention relates to an improved and simplified shade roller spring motor assembly, in which the drive spring is connected through a ball clutch to a spear by means of a greatly simplified apparatus and method of fabricating the assembly.

II. Background

Window shade support apparatus including a motor drive spring connected to a spear through a ball clutch is known in the prior art. Typically, the end of the drive spring remote from the spear is non-rotationally fixed in the far end of a dowel over which the spring is telescoped. The dowel is usually attached to a spear which in use is non-rotationally received by a mounting bracket. The end of the drive spring nearest the spear is connected to a rotating portion of the shade roller apparatus. Typically, numerous components have been required to assemble the spring motor and implement its connection of the drive spring to the rotating portion, as well as to form the clutching arrangement between the rotating portion and the non-rotating spear, to enclose the spear and the clutching apparatus, and to attach a dowel to the spear. Each of these components must be separately fabricated and handled, and then laboriously assembled into the completed product.

For example, U.S. Pat. No. 659,584 issued to E. C. Cordes on Oct. 9, 1900 teaches a spring shade roller having a shaft, a collar with pockets, a disc with a recess, a cap and securing means for the cap. The disc has lugs which are attached to the end of the spring drive nearest the spear. It can be appreciated that a reduction in the number of pieces required to fabricate a shade support and a corresponding simplification of fabrication would be desirable. Further, improving the securing means for the spear end of the driving coil to simplify fabrication is desirable.

U.S. Pat. No. 375,986 issued to G. T. Briggs on Jan. 3, 1888 teaches a spindle with a tapering ferrule and with an annular groove or channel for receiving the end nearest the spear of a coiled driving spring. Similarly, U.S. Pat. No. 1,329,992 issued to A. R. Nelson et al. on Feb. 3, 1920 and U.S. Pat. No. 1,803,042 issued to T. B. Thurman on Apr. 28, 1931 teach a drive spring coil slipped over a spindle with no inward radial compressive retaining force on the spring. It would be desirable to have a positive compressive force on the drive spring to better secure the spring from turning on the spindle or from slipping off the spindle. Additionally, the aforementioned patents teach fabricating the shade support roller using a multitude of parts such as sleeves, tubes, shafts, supporting brackets, nail-like protrusions, washers and caps. Again, it would be desirable to reduce the cost of manufacture by reducing the number of parts and simplifying the assembly process.

U.S. Pat. No. 3,763,916 issued to R. C. Gossling on Oct. 9, 1973 teaches a window shade motor which includes an allegedly improved connection of the spear end of the drive spring to a rotating portion of the shade roller. As before, the spring is slipped over a spindle. However, in addition, the drive spring includes a bent portion near its end which engages a recess in a body element of the window shade motor. The end of the drive spring, just beyond the bent portion, extends into and engages the inside of the roller wall. Accordingly, the inside of the roller wall applies a loading force to the end of the bent portion to keep the bent portion in the recess. It would be desirable to more evenly distribute any compressive force over the secured end portion of the driving spring to better retain the driving spring. Further, it would be desirable to simplify the apparatus and fabrication of the window shade support.

It is an object of this invention to simplify the apparatus of a shade support assembly and to reduce the number of parts in such an assembly.

It is a further object of this invention to simplify the manufacturing process used in window shade support roller assembly, thereby reducing the time required to assemble the support assembly and reducing the labor and expense required by manufacture.

It is thus a major objective of this invention to provide a new type of shade roller construction having greatly improved simplicity of structure, durability, and economy of manufacture, together with a new method of manufacturing such an assembly.

SUMMARY OF THE INVENTION

To these and other ends, apparatus and fabrication of a shade roller assembly in accordance with an embodiment of this invention includes a spring-retaining structure having ball-retaining recesses with canted floors, a spear structure, balls for a ball clutch, a spring support dowel, a drive spring and an outer tube. The spring-retaining structure has a central barrel with resilient circumferentially spaced spring-gripping lugs projecting parallel to the axis of the central barrel and radially spaced outwardly from the barrel. The spear structure has an integral spear and a central barrel smaller in diameter than the barrel of the spring retaining structure and insertable therethrough to join such two parts together. In so doing, the ball clutch is also assembled, since each of these parts defines a mutually cooperating portion of the clutch, as explained more fully hereinafter.

In the assembly process made possible by the invention, the balls are placed in the ball retaining recesses of the spring retaining structure. This can be done efficiently and positively because the canted floor allows each ball to rest partially against a side wall of the recess, thus preventing the balls from rolling out of their ball retaining recesses.

In another operation (which may optionally preceed ball placement), the barrel of the spear structure is inserted into the barrel of the spring retaining structure and snapped into place. Slots in the barrel of the spear structure together with its structural flexibility permit compression, or circumferential contraction, of the spear structure barrel when being inserted into the spring-retaining structure. Flanges at the end of the spear structure barrel pass through the spring-retaining structure and snap out to positively engage the end of the spring retaining structure barrel, to thereby couple the two structures securely together.

In a third operation, the spring support dowel is inserted into and secured within the central opening of the spear structure barrel. As a result, the dowel is secured against rotation and is able to torsionally wind the spring, and the dowel also prevents the spear structure from being compressed or contracted to permit withdrawal of the spring retaining structure. Accordingly, with the end flanges of the spear structure firmly indexed behind the spring-retaining structure, the two pieces are securely joined.

In a fourth operation, the coil-type drive spring is telescoped over the spring support dowel and its leading end is inserted between the barrel and spring-compression lugs of the spring retaining structure. As a result, this end of the spring is securely retained from rotation and from axial withdrawal.

In a fifth operation, a window shade support tube is telescoped over the spring and over the compression lugs of the spring-retaining structure. Typically, the window shade is attached to the tube. The tube further compresses or annularly contracts the compression lugs, thereby even further securing the spring. The end of the tube is abutted against an edge of the spring-retaining structure to prevent relative lateral movement of the tube.

An assembly in accordance with a preferred embodiment of this invention is particularly advantageous because of the relatively few parts required to fabricate the assembly. The fabrication of the assembly is advantageous because of the relatively few operations required and of the simplicity and rapidity with which the operations can be correctly accomplished.

DRAWINGS

Figure 5A:
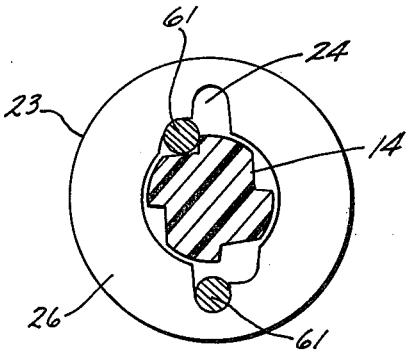
Figure 5B:
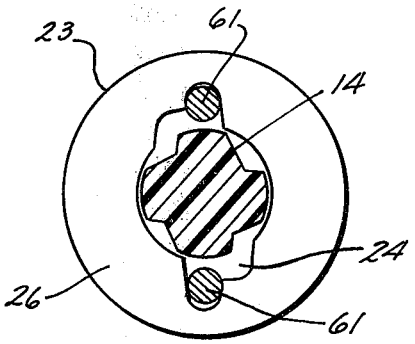
Figure 6:
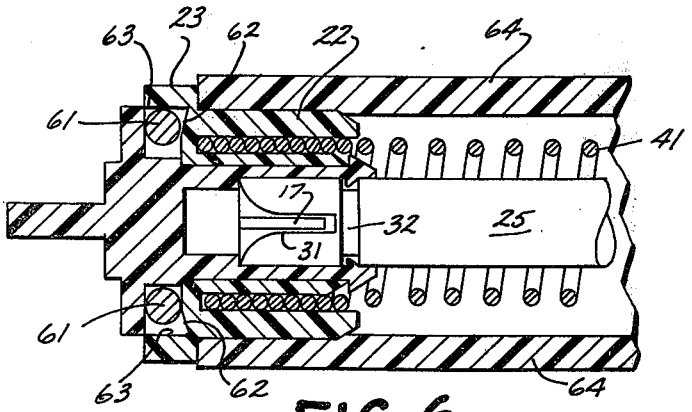
Figure 4:
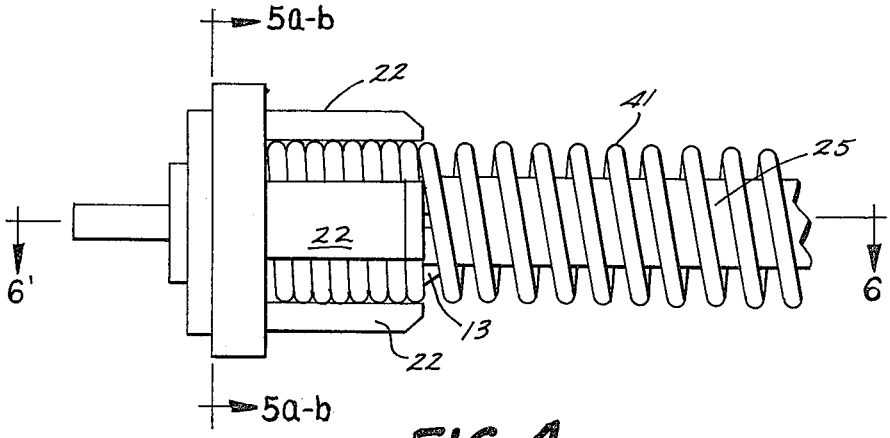
FIG. 4 is an elevational view of the assembly of FIG. 3, together with the addition of a drive spring inserted in secured position.

FIGS. 5*a* and 5*b* are cross-sectional views along section V*a–b*—V*a–b* of FIG. 4 showing a ball clutch in a locked and an unlocked position; and FIG. 6 is a longitudinal cross-sectional view of the assembly shown in FIG. 4, along the plane VI—VI.

DETAILED DESCRIPTION

Figure 1:
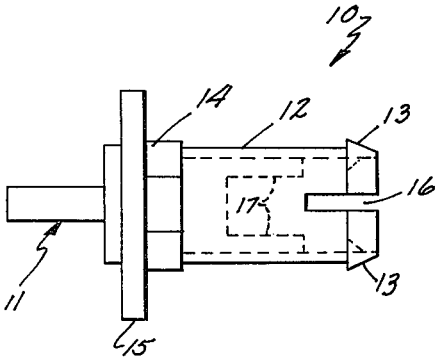
FIG. 1 is a side elevational view of a spear structure in accordance with an embodiment of this invention.

Referring to FIG. 1, the spear structure 10 has certain portions which engage an external window shade support bracket, while others act to form part of a ball clutch arrangement. In the embodiment illustrated, such portions include a solid, substantially rectangular spear 11, preferably as an integral part of spear structure 10. Typically, spear 11 is received in a slotted external bracket used for supporting the shade and preventing rotation of the spear. Spear structure 10 further integrally includes an end cap 15, a barrel 12 and a flange 13 at the end of barrel 12. End cap portion 15 is a thin disc-like cylindrical solid. Barrel 12 is a tubular section having a blind central cylindrical opening with a pair of internal ribs 17. Flange 13 surrounds an end portion of barrel 12 to provide a truncated cone-shaped ridge near such end portion, as illustrated. Spear 11 projects from end cap 15 in a first direction along the central axis of end cap 15 and barrel 12 projects in the opposite direction. To provide for compression, or annular contraction, of the flanged end of barrel 12 there are two (or more) diametrically opposed slots 16, parallel to the central axis of structure 10, extending through flange 13 and a portion of barrel 12. It can be appreciated that the number of slots can vary. A ratchet arrangement 14 is part of spear structure 10 and is used as part of a ball clutching arrangement for a spring drive of the shade. Ratchet arrangement 14 surrounds a portion of barrel 12 adjacent end cap 15 and includes circumferentially-spaced protrusions extending radially outward from barrel 12. A cross-sectional view of ratchet arrangement 14 is shown in FIGS. 5*a* and 5*b*. Typically, spear structure 10 is made as one piece, preferably from nylon, by an injection molding process.

Figure 2:
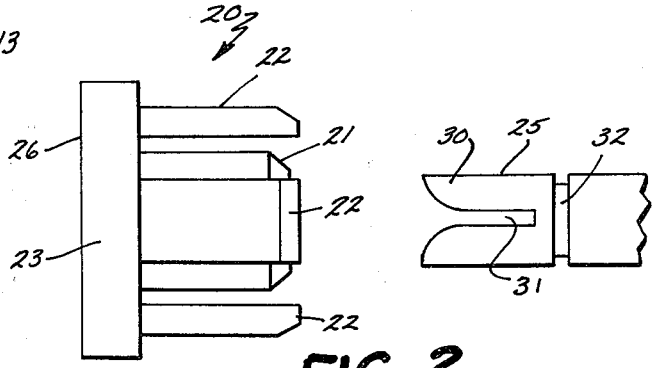
FIG. 2 is a side elevational view of spring-retaining structure and a fragmentary portion of a spring support dowel in accordance with an embodiment of this invention, showing the relative alignment therebetween.

FIG. 2 shows a spring retaining structure 20 which includes a spring-retaining barrel 21 and spring-compression lugs 22. Also shown is the relative alignment of a spring support dowel 25 having a slotted end 30, disposed coaxially with barrel 21. An end disc 23 provides a support or base from which project barrel 21 and lugs 22. End disc 23 is a disc-like cylindrical solid having an aligned central cylindrical opening (not seen in FIG. 2). Barrel 21 is a tubular projection having an aligned central cylindrical opening. The central openings of disc 23 and barrel 21 are aligned and communicate with one another. The diameter of the opening of disc 23 is at least as great as the diameter of the opening in barrel 21.

The lugs 22 are circumferentially spaced, axially aligned portions forming in essence a slotted cylindrical shell. One end of each lug can be tapered toward the central axis of barrel 21. Lugs 22 are longitudinally aligned with the central axis of barrel 21, circumferentially spaced from each other around the barrel, and radially spaced therefrom so that the end of a coil spring can be fitted into the annular space between lugs 22 and barrel 21.

FIG. 6 shows a cross-sectional view of spring-retaining structure 20, where it can be observed that end disc 23 has recesses 24 in its lateral side 26, opposite from barrel 21, for receiving balls 61. In accordance with an embodiment of this invention, the recesses have canted floors 62 (FIG. 6), i.e., the floors of the recesses angularly deepen as the radial distance from the central axis increases. During manufacture, canted floors 62 are particularly advantageous for retaining balls 61 against side walls 63 of the recesses. Such positive placement of balls 61 facilitates the manufacturing process. The cross sectional view of FIG. 5*b* shows how a ball placed on canted floor 62 would automatically (i.e., by gravity) roll into position against sidewall 63. Preferably, as with spear structure 10, spring-retaining structure 20 is made from nylon by an injection molding process. Of course, structure 10 and 20 could be made from various other materials, including, for example, various other plastics.

Figure 3:
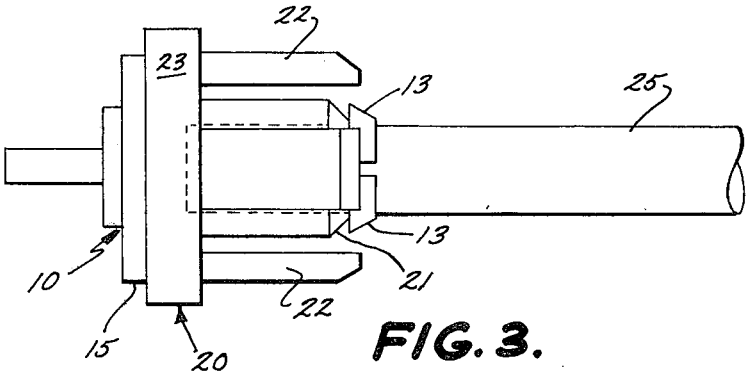
FIG. 3 is an elevational view of an assembled spear structure, spring retaining structure and spring support dowel, in accordance with an embodiment of this invention.

FIG. 3 shows an assembly of spring support dowel 25, spring-retaining structure 20 and spear structure 10. In particular, barrel 12 and flange 13 of spear structure 10 have been inserted through the central opening in barrel 21 of spring-retaining structure 20. During insertion, the slots 16 permit portions of barrel 12, including the flange 13, to squeeze toward each other, and then to snap outward once through barrel 21. The lengths of barrels 12 and 21 are adapted so that when ridge flange 13 snaps outward it butts against the end of barrel 21, at which time end cap 15 is flush against (or narrowly clears) end disc 23. Accordingly, structures 10 and 20 are simply and positively connected, being self-retaining. The insertion of spear structure 10 into structure 20, or at least the insertion of the balls 61 into their recesses 24, is preferably done with the ball-retaining recesses of structure 20 opening upward. That is, after initial insertion of spear structure 10 but prior to the time when ridge 13 snaps out into place behind the end of barrel 21, the balls 61 are placed into their recesses 24, where they rest on canted floors 62, whereupon spear assembly 10 is inserted the rest of the way into structure 20. The one-way clutching action required in a shade roller is complete after the simple operations of inserting the balls into the ball-retaining recesses and inserting structure 10 fully into structure 20.

After the complete insertion of spear structure 10, dowel 25 is inserted in the central opening of its barrel 12. The diametral fit between dowel 25 and barrel 12 is such that the presence of the dowel prevents barrel 12 from being compressed sufficiently to allow flange 13 to pass back through barrel 21 of structure 20. This further insures the proper cooperation of structures 10 and 20 both in support of the final shade assembly and in the clutching action to control shade winding. While it is possible to merely secure dowel 25 within the opening of barrel 12 by gluing or other such measures, it is preferred to use a self-retaining, snap-fit construction as illustrated. This includes a straight-sided groove 32 (FIGS. 2 and 6) around the circumference of dowel 25 immediately inward of the diametral slot 31 which forms the aforementioned divided end 30 of the dowel. Also, barrel 12 of spear structure 10 has a conical internal ridge 18 (FIGS. 1 and 6) similar to its outer such ridge 13 already described. When dowel 25 is inserted into spear structure 10, the interaction between ridge 18 and dowel 25 at first causes diametral enlargement of the spear structure barrel, but when the groove 32 comes into alignment with ridge 18 the latter snaps into place within the groove locking the dowel in place. In this operation the end slot 31 of dowel 25 (which preferably has the same such shape at each end) must first be rotated into alignment with the internal ribs 17 of the spear structure barrel, which thus slide into such end slot and there act to preclude relative rotation between the dowel and the spear structure.

Referring to FIGS. 4 and 6, a spring 41 is shown, which is to be understood as being attached to dowel 25 at the end thereof opposite spring retainer 20 (not shown) in a conventional way, as by an offset diametrally disposed end of the spring which engages the slot in the end of the dowel. At the opposite end, shown in the drawings, the spring is compressed (i.e., radially contracted) and inserted between lugs 22 and barrel 21. The securing of spring 41 between lugs 22 and barrel 21 is particularly advantageous because this securely retains one end of the spring without the need for any mechanical fasteners such as pins, clips, staples or tacks, which are often used for such purpose. Further, eliminating such attachment devices simplifies and reduces the labor and time required by the manufacturing process. Spring 41 is secured by a simple axial thrusting insertion, preferably including at least some rotation of the spring end at the same time.

In this connection, it should be observed that the inside diameter of spring 41 preferably fits complementarily over the outside of barrel 21, with the annular clearance between the inside surfaces of the lugs 22 and the outside of barrel 21 being preferably on the order of, or slightly less than, the diameter of the wire from which spring 41 is wound, so as to provide an interference fit therebetween. Further, the lugs are preferably at least slightly flexible. Accordingly, in such a preferred embodiment, when the spring is inserted into place, the lugs are forced outwardly at least slightly, whereupon their natural resilience or "plastic memory" causes them to grip the outside of the spring, contracting it annularly, radially about the barrel 21. The end of spring 41 inserted between lugs 22 and barrel 21 may if desired have a lateral, radially bent end portion. Such an end portion is inserted between lugs 22 and can butt up against the side of a lug to ensure that no rotation of drive spring 41 can occur with respect to spring retaining structure 20. Because the entire spring motor assembly, including lugs 22, is subsequently inserted into a tube, any such bent end portion of the spring should have a radial extension less than the maximum radial extension of any portion of lugs 22, so as not to engage the inside wall of such tube. It is to be pointed out, however, that such an offset or bent end of the drive spring is not essential to the satisfactory practice of the invention, since the engagement of the spring between the barrel 21 and lugs 22 will hold the spring very satisfactorily against rotational slippage of the spring, allowing the latter to be torsionally wound upon the dowel for driving operation between the spear structure 10 and its receiving and cooperating structure, upon rotation therebetween through the ball clutch.

FIGS. 5*a* and 5*b* illustrate the operation of the ball clutch. In the locked position, shown in FIG. 5*a*, one (or, at times, two) side of the ratchet surface arrangement 14 is engaged by one (or both) of the balls 61. In the unlocked position, shown in FIG. 5*b*, the sides of ratchet arrangement 14 are free to turn, clear of balls 61. As will be understood, the basic nature of such a clutch is known in the art and no detailed description is therefore required here.

FIG. 6 shows a cross-sectional view of a completely assembled shade support roller and spring motor. In this view, an outer shade support tube 64 is shown in place over drive spring 41, the spring motor assembly having been inserted fully therein. During such insertion, lugs 22 frictionally engage, and preferably embed into, the inside wall of tube 64, and this serves to radially compress or contract the lugs tightly about spring 41, forcibly trapping the same against barrel 21. Tube 64 provides an attachment means, and a support for, the window shade panel.

Various modifications and variations will no doubt occur to those skilled in the various arts to which this invention pertains. For example, the support dowel may be provided with side protrusions to positively engage the slots in the barrel of the spear assembly. Also, spring retaining surfaces may be grooved to improve retention. These and all other variations which are based upon the teachings through which this disclosure has advanced the art are properly considered within the scope of this invention.

The embodiments of the invention in which an exclusive property or privilege is claimed are defined as follows:

1. A window shade support assembly comprising:

a spear structure having means for engaging an external support bracket and means for forming a portion of a window shade clutch;

a spring-retaining structure having means for cooperatively engaging the spear structure, means for forming another portion of a window shade clutch, and means for positively retaining a drive spring; and means acting in cooperation with said clutch portions of the spear structure and the spring retaining structure for providing a window shade roller clutching mechanism;

and radially-projecting portions extending laterally from at least one of said spear structure or said spring-retaining structure and interfitting with the other such structure to maintain the two structures assembled together.

2. An assembly as recited in claim 1 wherein the spear structure comprises:

a substantially rectangular, integral spear portion for engaging a slotted shade support bracket;

a generally cylindrical barrel portion extending away from the spear portion, the barrel portion having radially projecting portion comprising engagement means for engaging said spring-retaining structure and fitting around portions thereof to thereby help to maintain such structure assembled to said spear structure.

3. A window shade support assembly comprising:

a spear structure having means for engaging an external support bracket and means for forming a portion of a window shade clutch;

a spring-retaining structure having means for cooperatively engaging the spear structure, means for forming another portion of a window shade clutch, and means for positively retaining a drive spring; and means acting in cooperation with said clutch portions of the spear structure and the spring retaining structure for providing a window shade clutching mechanism.

said spring-retaining structure comprising an end surface having at least one ball-receiving recess, a barrel portion projecting laterally away from the end surface, in a direction opposite said recess, and spring-retaining lugs extending in the same direction as the barrel circumferentially spaced from each other to form an annular locus and radially spaced from the barrel sufficiently to receive and frictionally engage a spring therebetween.

4. A window shade support assembly comprising:

a spear structure including an integral spear portion and a barrel portion which portions project in opposite directions along a central axis of the spear structure, the barrel portion having a compressible end portion and an interlock element; and a spring-retaining structure including a barrel having a central opening for receiving the barrel of the spear assembly and means for engaging and interlocking with said interlock structure of the spear assembly;

said spring-retaining structure further including a plurality of lugs which project around the outside of the barrel, are generally aligned with the axis of the barrel, are spaced from the barrel, and are adapted for compressively engaging a spring inserted between the barrel and the lugs.

5. An assembly as recited in claim 4 further comprising:

a ball receiving recess defined in an end portion of the spring retaining structure, the opening of the recess being on the opposite side of the structure from the barrel, and the floor of the recess having a cant to form a deeper recess as the radial distance from the axis of the spring retaining structure increases.

6. An assembly as recited in claim 4 further comprising:

a ball receiving recess defined in an end portion of the spring retaining structure, the opening of the recess being on the opposite side of the structure from the barrel, and a ratchet arrangement around the barrel of the spear structure adapted for use as part of a ball clutch arrangement in cooperation with the spring retaining structure; and a ball in the ball receiving recess acting in cooperation with said ratchet arrangement and portions of the spring retaining structure to provide a ball clutching action.

7. A shade drive spring retaining structure comprising:

an end wall part having at least one ballreceiving recess with a floor having a cant to form a deeper recess as the radial distance from the central axis of the spring retaining structure increases;

a barrel portion projecting in at least a first direction from said end wall and centrally oriented with respect to said axis;

resilient compression lugs extending from the wall in the same direction as the barrel and generally parellel to said axis, said lugs being circumferentially spaced from each other around the periphery of the barrel with a radial spacing between the barrel and the lugs for receiving and retaining a spring.

8. A shade spear structure comprising:

a spear portion for engaging a slotted shade support bracket;

a barrel portion integral with said spear portion and extending away from the latter, symmetric about the central axis of the spear portion, the barrel portion having a compressible end with a projecting flange at the barrel end away from the spear;

a ratchet arrangement around the barrel at the end thereof closest to the spear for use as part of a clutch; and an end cap portion having a generally disclike shape and separating the spear portion from the barrel and ratchet arrangement.

9. In a ball clutch assembly for a shade roller, the improvement comprising:

means defining a ball-receiving recess having side walls located at a distance radially outward from the axis of the shade roller and having a canted floor which forms a deepening recess as the radial distance from the axis of the shade roller increases and approaches said side walls.

10. A window shade support assembly comprising:

a spear structure including an integral spear portion and a barrel portion which portions project in opposite directions along a central axis of the spear structure;

a spring-retaining structure including a barrel for engaging with the barrel of the spear structure, and means for holding the barrels together when so engaged;

an elongated dowel member extending generally axially of said spear structures in a direction away from said spear ortion thereof, and interlock portions on said dowel and said barrel portion of said spear structure, said interlock portions extending generally transversely of the spear structure axis at least in part and engaging one another in a manner inhibiting axial separation of the dowel member and the spear structure. portion

11. An assembly as recited in claim 10 wherein at least certain of said interlock portions comprise resiliently flexible formations which flex to engage other interlock portions.

12. The assembly as defined in claim 11, wherein at least some of said flexible formation are carried on said spear structure barrel.

13. The assembly as defined in claim 12, wherein said spear structure barrel also carries resiliently biased formations disposed to index behind said spring retaining structure to hold the spear structure and spring retaining structure against axial separation.

* * * * *

UNITED STATES PATENT AND TRADEMARK OFFICE

CERTIFICATE OF CORRECTION

PATENT NO. : 4,009,745
DATED : March 1, 1977
INVENTOR(S) : Paul J. Erpenbeck

It is certified that error appears in the above-identified patent and that said Letters Patent are hereby corrected as shown below:

Column 8, line 21:

"ballreceiving" should be --- ball-receiving ---;

Column 8, line 45:

"disclike" should be --- disc-like ---;

Column 8, line 67:

"ortion" should be --- portion ---;

Column 9, line 5:

after "structure." delete --- portion ---.

Signed and Sealed this

Seventh Day of June 1977

[SEAL]

*Attest:*

RUTH C. MASON
*Attesting Officer*

C. MARSHALL DANN
*Commissioner of Patents and Trademarks*